US010100454B2

(12) United States Patent
Jo et al.

(10) Patent No.: US 10,100,454 B2
(45) Date of Patent: Oct. 16, 2018

(54) LAUNDRY TREATING APPARATUS

(71) Applicant: LG ELECTRONICS INC., Seoul (KR)

(72) Inventors: Mingyu Jo, Seoul (KR); Sungmin Kim, Seoul (KR); Seungjoon Kim, Seoul (KR); Seungchul Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 15/100,515

(22) PCT Filed: Mar. 24, 2016

(86) PCT No.: PCT/KR2016/002998
§ 371 (c)(1),
(2) Date: May 31, 2016

(87) PCT Pub. No.: WO2016/159570
PCT Pub. Date: Oct. 6, 2016

(65) Prior Publication Data

US 2017/0107655 A1 Apr. 20, 2017

(30) Foreign Application Priority Data

Apr. 1, 2015 (KR) ..... 10-2015-0046178

(51) Int. Cl.
*D06F 37/22* (2006.01)

(52) U.S. Cl.
CPC ..... *D06F 37/225* (2013.01)

(58) Field of Classification Search
CPC ..... D06F 37/225; D06F 37/203; D06F 33/02; D06F 2222/00; D06F 37/245
(Continued)

(56) References Cited

U.S. PATENT DOCUMENTS 3,800,622 A * 4/1974 Stelwagen ..... D06F 37/225 210/363
2012/0144598 A1* 6/2012 Ostdiek ..... D06F 37/06 8/137

(Continued)

FOREIGN PATENT DOCUMENTS

EP 1655404 A1 * 5/2006 ..... D06F 37/225
EP 1655404 A1 * 5/2006 ..... D06F 37/225

(Continued)

OTHER PUBLICATIONS

Pfenninger et al., "Washing Machine with Tanks for Unbalance Compensation" Aug. 2006, EP 1693500—Machine Translation.*

*Primary Examiner* — David G Cormier
*Assistant Examiner* — Thomas Bucci
(74) *Attorney, Agent, or Firm* — Dentons US LLP

(57) ABSTRACT

Disclosed is a laundry treatment apparatus including a cabinet defining an external appearance of the laundry treatment apparatus, a drum rotatably provided inside the cabinet, the drum being configured to accommodate laundry therein, a drive unit configured to generate torque required to rotate the drum, a power transmission unit provided on one surface of the drum, the power transmission unit being configured to transmit the torque generated by the drive unit to the drum so as to rotate along with the drum, and at least one balancer provided on an inner circumferential surface of the drum. Water is selectively supplied into the balancer so as to eliminate unbalance occurring in the drum, and the balancer has a shorter length than a longitudinal length of the drum.

12 Claims, 4 Drawing Sheets

(58) Field of Classification Search
USPC ..... 68/23.2, 12.06, 140, 139, 23.1, 24, 142, 68/200, 23.5, 3 R, 212, 58; 74/572.4
See application file for complete search history.

(56) References Cited

U.S. PATENT DOCUMENTS

| | | | | |
|---|---|---|---|---|
| 2012/0144874 | A1* | 6/2012 | Erickson | D06F 37/225 68/23.1 |
| 2012/0144879 | A1* | 6/2012 | Verma | D06F 37/225 68/200 |
| 2012/0144880 | A1* | 6/2012 | Erickson | D06F 37/225 68/200 |
| 2012/0144881 | A1* | 6/2012 | Farid | D06F 37/225 68/200 |
| 2013/0031939 | A1* | 2/2013 | Hasanreisoglu | D06F 37/065 68/139 |

FOREIGN PATENT DOCUMENTS

| | | | | |
|---|---|---|---|---|
| EP | 1693500 | A2 * | 8/2006 | D06F 37/225 |
| EP | 1693500 | A2 * | 8/2006 | D06F 37/225 |
| EP | 2463432 | A1 * | 6/2012 | D06F 37/065 |
| EP | 2463432 | A1 * | 6/2012 | D06F 37/065 |
| JP | 2002-136792 | A | 5/2002 | |
| KR | 20-0155392 | Y1 | 11/1997 | |
| KR | 10-2006-0039761 | A | 5/2006 | |
| KR | 10-0785386 | A | 5/2006 | |
| KR | 10-2013-0077981 | A | 7/2013 | |
| KR | 10-1295360 | B1 | 8/2013 | |
| KR | 10-2014-0102014 | A | 8/2014 | |

* cited by examiner

LAUNDRY TREATING APPARATUS

This application is a National Stage Application of International Application No. PCT/KR2016/002998 filed Mar. 24, 2016, which claims priority from Korean Application No. 10-2015-0046178 filed on Apr. 1, 2015, each of which are hereby incorporated by reference in their entirety.

TECHNICAL FIELD

The present invention relates to a laundry treatment apparatus.

BACKGROUND ART

A conventional laundry treatment apparatus includes a cabinet defining the external appearance of the laundry treatment apparatus, a tub installed inside the cabinet, a drum rotatably installed inside the tub, the drum serving to wash laundry, a power transmission unit installed to transmit torque to the drum in order to rotate the drum, and a motor fixed to the power transmission unit, the motor having a rotating shaft installed to penetrate the tub.

The drum may fail to maintain dynamic balance due to the position of the laundry contained in the drum, thus being rotated.

Dynamic balance means the state in which centrifugal force or a moment made by the centrifugal force when a rotator rotates becomes zero with respect to a rotation axis. In the case of a rigid body, dynamic balance is maintained when the distribution of the mass is constant about a rotation axis.

Accordingly, the dynamic balance of the laundry treatment apparatus may be understood as the case where, when the drum, in which laundry is stored, rotates, the distribution of the mass of the laundry is within an allowable range about the rotation axis of the drum (i.e. the case where the drum rotates while vibrating within an allowable range).

On the other hand, in the laundry treatment apparatus, the state in which dynamic balance is broken (i.e. the unbalanced state) is the state in which the distribution of the mass of the laundry is not constant about the rotation axis of the drum while the drum is rotating. This occurs when the laundry is not uniformly distributed inside the drum.

When the drum rotates in the unbalanced state, the drum vibrates, and the vibrations of the drum are transmitted to the tub or the cabinet, causing noise.

The conventional laundry treatment apparatus includes a balancing unit for eliminating the unbalance of the drum. A ball balancer or fluid balancer in which a ball or fluid is provided inside a housing, which is fixed to the drum, has been used as the balancing unit of the conventional laundry treatment apparatus.

The ball balancer or fluid balancer included in the conventional laundry treatment apparatus is configured to control unbalance caused by laundry by the movement of the ball or fluid in the direction opposite the direction in which the laundry that is causing the unbalance is located, when the rotational path of the drum fluctuates due to the laundry.

However, the control of unbalance described above is available in a steady state in which the vibrations of the drum are within a given range, but cannot anticipate great effects in the transient vibration state in which the vibrations of the drum are excessive.

In addition, the conventional balancing unit has difficulty in rapidly (actively) eliminating the unbalance once the unbalance has occurred.

In addition, although there is a method of rapidly supplying water to the balancer in order to rapidly eliminate the unbalance, this method has difficulty in efficiently draining the water supplied to the balancer.

In addition, the method of supplying water to the balancer in order to eliminate the unbalance requires the balancer to be mounted to the drum. In this case, however, a space is formed between the balancer and the drum, which makes it difficult to efficiently supply water to the balancer.

DISCLOSURE

Technical Problem

Accordingly, the present invention is directed to a laundry treatment apparatus that substantially obviates one or more problems due to limitations and disadvantages of the related art.

One object of the present invention is to provide a laundry treatment apparatus, which may actively and efficiently remove the unbalance of a drum in the transient vibration state, which is an unbalanced state of the drum in which laundry is not uniformly distributed inside the drum.

In addition, another object of the present invention is to provide a laundry treatment apparatus, which is configured to efficiently drain water supplied into a balancer in order to actively eliminate the unbalance of a drum.

In addition, a further object of the present invention to provide a laundry treatment apparatus, which is configured to allow a balancer, which serves to actively eliminate the unbalance of a drum, to be more easily mounted to a drum, thereby accomplishing the efficient supply of water to the balancer.

Technical Solution

To achieve these objects and other advantages and in accordance with the purpose of the invention, as embodied and broadly described herein, in accordance with one embodiment of the present invention, a laundry treatment apparatus includes a cabinet defining an external appearance of the laundry treatment apparatus, a drum rotatably provided inside the cabinet, the drum being configured to accommodate laundry therein, a drive unit configured to generate torque required to rotate the drum, a power transmission unit provided on one surface of the drum, the power transmission unit being configured to transmit the torque generated by the drive unit to the drum so as to rotate along with the drum, and at least one balancer provided on an inner circumferential surface of the drum, wherein water is selectively supplied into the balancer so as to eliminate unbalance occurring in the drum, and wherein the balancer has a shorter length than a longitudinal length of the drum.

The balancer may have one end configured to communicate with the power transmission unit, and the balancer may have an opposite end spaced apart from a front surface of the drum by a given distance.

The laundry treatment apparatus may further include a balancer cover provided between the balancer and the front surface of the drum.

The laundry treatment apparatus may further include a water supply channel provided inside the balancer cover for movement of the water to be supplied into the balancer.

The water supply channel may be assembled by sliding from an outside of the front surface of the drum to an inside of the drum.

The water supplied into the balancer may be supplied to a front of the balancer and is drained to a rear of the balancer.

The balancer may be provided in a longitudinal direction on the inner circumferential surface of the drum.

The balancer may protrude inward into the drum to a prescribed height and may include a cavity therein.

The laundry treatment apparatus may further include a balancer water supply unit configured to penetrate the tub so as to be exposed between the tub and the drum, the balancer water supply unit serving to supply water.

The balancer cover may include a water supply hole provided in a front end of the balancer cover so as to provide a space required to supply water into the balancer, and a drain hole provided in a rear end of the balancer cover so as to provide a space required to drain the water inside the balancer.

The balancer water supply unit may be located higher than the water supply hole.

The laundry treatment apparatus may further include a water supply guide configured to protrude from the water supply hole forward of the drum.

The laundry treatment apparatus may further include a water supply guide configured to be inclined from the water supply hole toward a center axis of the drum.

The power transmission unit may include a center portion, to which a shaft is mounted, and a plurality of extensions configured to extend from the center portion in a radial direction of the drum, and the at least one balancer may include a plurality of balancers communication with the respective extensions.

The extensions may be provided in the same number as the balancers.

The balancer may include a drain hole provided in a rear end of the balancer so as to provide a space required to drain the water inside the balancer, and each of the extensions may include a drain connector configured to communicate with the drain hole.

The laundry treatment apparatus may further include a drain duct provided inside each of the extensions, the drain duct being configured to communicate with the drain connector so as to form a flow path, through which the water drained from the balancer is drained.

Advantageous Effects

The present invention has the effect of providing a laundry treatment apparatus, which may actively and efficiently remove the unbalance of a drum in the transient vibration state, which is an unbalanced state of the drum in which laundry is not uniformly distributed inside the drum.

In addition, the present invention has the effect of providing a laundry treatment apparatus, which is configured to efficiently drain water supplied into a balancer in order to actively eliminate the unbalance of a drum.

In addition, the present invention has the effect of providing a laundry treatment apparatus, which is configured to allow a balancer, which serves to actively eliminate the unbalance of a drum, to be more easily mounted to a drum, thereby accomplishing the efficient supply of water to the balancer.

DESCRIPTION OF DRAWINGS

The accompanying drawings, which are included to provide a further understanding of the present invention and are incorporated in and constitute a part of this application, illustrate embodiment(s) of the present invention and together with the description serve to explain the principle of the present invention. In the drawings.

BEST MODE

Figure 1A:
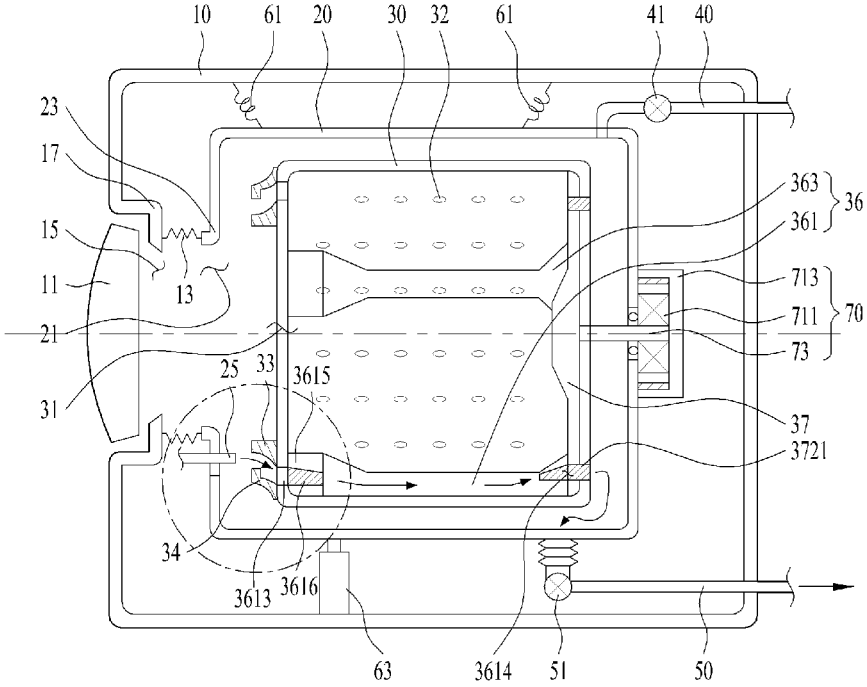
FIG. 1A is a view illustrating a laundry treatment apparatus in accordance with one embodiment of the present invention.

Hereinafter, exemplary embodiments of the present invention will be described in detail with reference to the accompanying drawings.

Unless otherwise defined, all terms used herein have the same meaning as commonly understood by one of ordinary skill in the art to which example embodiments belong. When the terms used herein conflict with the general meaning thereof, the terms conform to definitions used herein.

Meanwhile, the configuration of an apparatus or a control method of the apparatus, which will be described below, are merely given to describe the embodiments of the present invention, and are not intended to limit the scope of the present invention. The same reference numerals used throughout the specification refer to the same constituent elements.

FIG. 1A is a view illustrating a laundry treatment apparatus in accordance with one embodiment of the present invention.

Examples of a laundry treatment apparatus include a washing apparatus, which washes laundry, a drying apparatus, which dries laundry, and a washing and drying apparatus, which performs both washing and drying. When the laundry treatment apparatus is the washing apparatus, the washing apparatus includes a tub 20, which accommodates wash water. When the laundry treatment apparatus is the drying apparatus, the drying apparatus does not include the tub 20.

Hereinafter, for convenience of description, the laundry treatment apparatus of the present invention will be described as being the washing apparatus having the tub 20. However, the laundry treatment apparatus of the present invention is not limited only to the washing apparatus, and may be any one of the drying apparatus, which does not include the tub 20, and the washing and drying apparatus.

Referring to FIG. 1A, the laundry treatment apparatus in accordance with one embodiment of the present invention may include a cabinet 10, which defines the external appearance of the laundry treatment apparatus, a tub 20, which is provided inside the cabinet 10 and accommodates wash water therein, and a drum 30, which is rotatably provided inside the tub 20 and accommodates laundry therein.

The cabinet 10 includes a cabinet opening 15, which is provided to enable the introduction or discharge of laundry, a door 11, which is pivotably mounted to one surface of the cabinet 10 and is provided to open or close the cabinet opening 15, and a cabinet bent portion 17, which is bent toward the inside of the cabinet 10 and provides a space in which the door 11 is mounted.

The tub 20 includes a tub opening 21, which is provided to enable the introduction or discharge of laundry through the cabinet 10, a tub bent portion 23, which is bent toward the outside of the tub 20, and a balancer water supply unit 25, which supplies water to a balancer 36.

The cabinet bent portion 17 of the cabinet 10 may be bent toward the tub 20, and the tub bent portion 23 of the tub 20 may be bent toward the cabinet 10.

The laundry treatment apparatus in accordance with one embodiment of the present invention may further include a gasket 13 between the cabinet bent portion 17 and the tub bent portion 23, so as to prevent vibrations generated during the rotation of the drum 30 from being transmitted to the cabinet 10 through the tub 20, thus causing the generation of noise.

The balancer water supply unit 25 penetrates the tub 20, and the distal end of the balancer water supply unit 25 is located in the space between the tub 20 and the drum 30. The balancer water supply unit 25 may supply water to the space between the tub 20 and the drum 30.

The balancer water supply unit 25 is provided below the tub opening 21. The balancer water supply unit 25 may be provided at the same height as a water supply guide or a water supply hole, which will be described below, or may be provided higher than the water supply guide or the water supply hole. Alternatively, the balancer water supply unit 25 is located closer to the center axis of the drum 30 than the water supply guide or the water supply hole. This is because, even if the water supplied from the balancer water supply unit 25 performs a parabolic motion due to gravity while moving to the water supply guide or the water supply hole, the water may reach the water supply guide or the water supply hole, thus being supplied to the balancer.

The balancer water supply unit 25 may include a first balancer water supply unit 251 and a second balancer water supply unit 253, which are provided at different heights in order to supply water to different heights.

The laundry treatment apparatus in accordance with one embodiment of the present invention may include the balancer 36, which serves to actively eliminate unbalance that is caused when laundry collects at one side, and the balancer water supply unit 25, which ejects water to the balancer 36 in order to supply water to the balancer 36 based on prescribed conditions.

As illustrated in FIG. 1, the balancer water supply unit 25 may receive water from an external water source and supply the water to the balancer 36. Alternatively, the balancer water supply unit 25 may supply the wash water inside the laundry treatment apparatus, rather than water from the external water source, to the balancer 36.

The drum 30 may include a drum opening 31, which is provided to enable the introduction or discharge of laundry, a plurality of through-holes 32, which is formed in the circumferential surface of the drum 30 to allow wash water accommodated inside the tub 20 to be introduced into or discharged from the drum 30, a plurality of balancers 36, which is provided to remove the unbalance of the drum 30 described above, water supply guides 33, 34 and 35, which is provided to supply water to the balancers 36, and a power transmission unit 37, which is mounted on one surface of the drum 30 in order to transmit torque, required to rotate the drum 30, to the drum 30.

The balancers 36 may be placed inside the drum 30 so as to be arranged on the inner circumferential surface of the drum 30, and may protrude inward from the drum 30 to a prescribed height.

The main purpose of the balancers 36 is to eliminate the unbalance that occurs when laundry collects at one side when the laundry is rotated inside the drum 30. In addition, the balancers 36 serve as lifters, which protrude inward from the drum 30 to a prescribed height so as to lift the laundry inside the drum 30 as the drum 30 rotates.

In addition, three or more balancers 36 may be provided on the inner surface of the drum 30.

The balancers 36 are elongated in the longitudinal direction of the drum 30.

Each of the balancers 36 may include a balancer body 3611, which defines the external appearance of the balancer 36, and a plurality of partitions 3612, which defines a plurality of compartments within the balancer 36.

The balancer body 3611 includes a cavity to allow water to move therein.

The partitions 3612 are oriented perpendicular to the center axis of the drum 30, and are spaced apart from one another. As such, the water supplied to the balancer 36 is temporarily stored between the partitions 3612, thereby serving to remove the unbalanced state of the drum 30.

The water supply guides 33, 34 and 35 may be provided to guide the water ejected from the balancer water supply unit 25 to the inside of the balancer 36.

Meanwhile, in the laundry treatment apparatus in accordance with one embodiment of the present invention, the balancer 36 may include a single water supply hole 3613, or may include two or more water supply holes 3623 and 3643.

In the case where the single water supply hole 3613 is provided in the balancer 36, in order to allow the water ejected from the balancer water supply unit 25 to be introduced into the balancer 36, the present invention may include the first water supply guide 33 provided above the water supply hole 3613 and the second water supply guide 34 provided below the water supply hole 3613.

In another example, in the case where the two or more water supply holes 3623 and 3643 are provided in the balancer 36, in order to allow the water ejected from the balancer water supply unit 25 to be introduced into the first water supply hole 3623 and the second water supply hole 3643, the present invention may include the first water supply guide 33 provided above the first water supply hole 3623, the second water supply guide 34 provided below the first water supply hole 3623 or above the second water supply hole 3643, and the third water supply guide 35 provided below the second water supply hole 3643.

In this case, the first water supply guide 33, the second water supply guide 34, and the third water supply guide 35 may extend forward from the balancer 36, and may be inclined relative to the center of the drum 30.

Meanwhile, the water supply hole may be provided in a balancer cover 3615, which will be described later, rather than being provided in the balancer 36. The balancer cover 3615 may include the single water supply hole 3613, or may include the two water supply holes 3623 and 3643.

In the case where the single water supply hole 3613 is provided in the balancer cover 3615, in order to allow the water ejected from the balancer water supply unit 25 to be introduced into the balancer 36, the present invention may include the first water supply guide 33 provided above the water supply hole 3613 and the second water supply guide 34 provided below the water supply hole 3613.

In another example, in the case where the two or more water supply holes 3623 and 3643 are provided in the balancer cover 3615, in order to allow the water ejected from the balancer water supply unit 25 to be introduced into the first water supply hole 3623 and the second water supply hole 3643, the present invention may include the first water supply guide 33 provided above the first water supply hole 3623, the second water supply guide 34 provided below the first water supply hole 3623 or above the second water supply hole 3643, and the third water supply guide 35 provided below the second water supply hole 3643.

In this case, the first water supply guide 33, the second water supply guide 34, and the third water supply guide 35 may extend forward from the balancer cover 3615, and may be inclined relative to the center of the drum 30.

The power transmission unit 37 transmits torque generated in a drive unit 70, which is installed to the rear surface of the tub 20, to the drum 30.

The power transmission unit 37 is mounted to the rear surface of the drum 30 and is rotated along with the drum 30.

The reason why a shaft 73 of the drive unit 70 is not directly fixed to the drum 30 is because, when the shaft 73 is directly coupled to the drum 30 so as to rotate the drum 30, a load is transmitted to the drum 30, which has the risk of causing deformation or breakage of the drum 30.

The drive unit 70 may include a stator 711, which is fixed to the rear surface of the tub 20 and generates a magnetic field, a rotor 713, which generates torque by the magnetic field generated by the stator 711, and the shaft 73, which connects the rotor 713 and the power transmission unit 37 to each other so as to transmit the torque.

The power transmission unit 37 may include a center portion 370 to which the shaft 73 is mounted, and a plurality of extensions 371, which extend from the center portion 370 in the radial direction of the drum 30.

The extensions 371 may be provided in the same number as the balancers 36 provided on the drum 30. Although will be described below, this serves to cause the water accommodated in the balancer 36 to be discharged outward from the drum 30 through the power transmission unit 37. To this end, the power transmission unit 37 communicates with the balancers 36 provided on the inner surface of the drum 30.

Meanwhile, the laundry treatment apparatus in accordance with one embodiment of the present invention may include a water supply hose 40, which is provided to supply wash water to the tub 20, a water supply valve 41, which adjusts the amount of wash water supplied to the tub 20, a drain hose 50, which is provided to drain the wash water inside the tub 20, and a drain valve 51, which adjusts the amount of wash water drained from the tub 20.

In addition, the laundry treatment apparatus in accordance with one embodiment of the present invention may further include a vibration unit, in order to prevent vibrations, generated during the rotation of the drum 30, from being transmitted to the cabinet 10 through the tub 20.

The vibration unit may include a first vibration member 61, which is an elastic member, and a second vibration member 63, which is a damper. The first vibration member 61 may be provided on the upper surface of the tub 20, and the second vibration member 63 may be provided on the lower surface of the tub 20.

Figure 2:
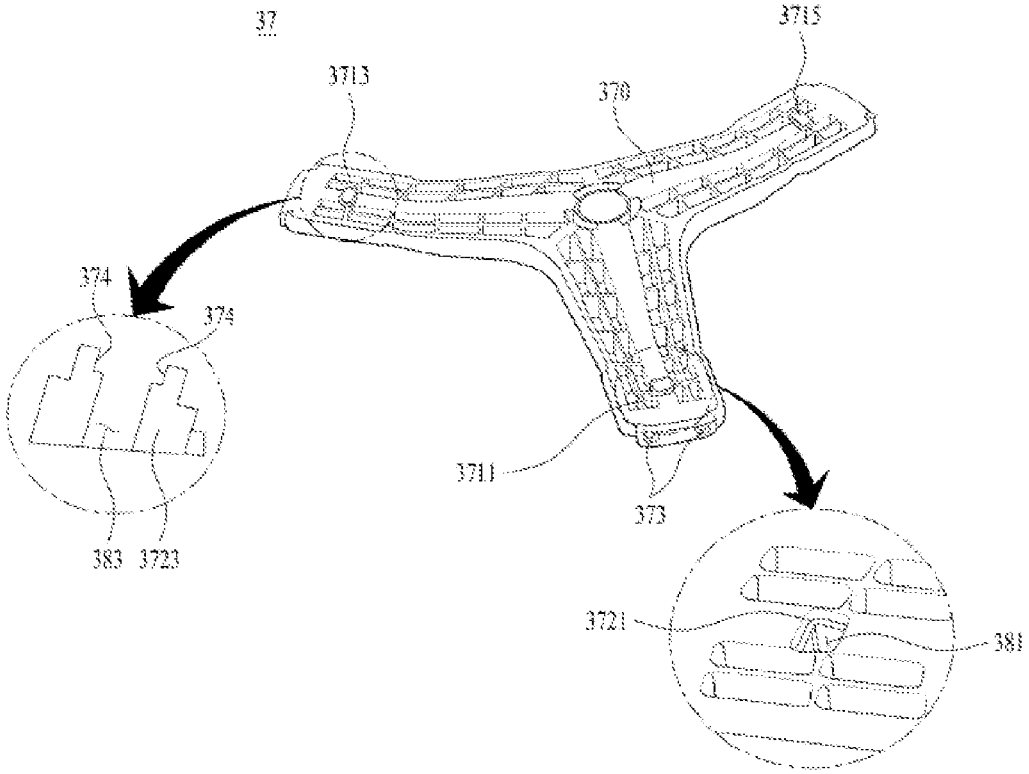
FIG. 2 is a view illustrating a power transmission unit of the laundry treatment apparatus in accordance with one embodiment of the present invention.

FIG. 2 is a view illustrating the power transmission unit of the laundry treatment apparatus in accordance with one embodiment of the present invention.

Referring to FIG. 2, as described above, the power transmission unit 37 may include the center portion 370 and the extensions 371 extending from the center portion 370 in the radial direction of the drum 30, and the extensions 371 may be provided in the same number as the balancers 36.

Each of the extensions 371 communicates with one end of a corresponding one of the balancers 36. This serves to allow the water accommodated inside the balancer 36 to be drained into the tub 20 by passing through the extension 371 and the drum 30.

Meanwhile, the extension 371 includes an extension drain hole 373 formed in the distal end thereof in order to drain the water temporarily stored therein. In addition, the drum 30 includes a drum drain hole (not illustrated), which communicates with the extension drain hole 373. As such, the water accommodated in the balancer 36 is drained and moves into the extension 371, and successively moves to the tub 20 through the extension drain hole 373 and the drum drain hole (not illustrated).

In the case where three balancers 36 are provided, the extensions 371 may include a first extension 3711, a second extension 3713, and a third extension 3715, which are provided in the same number as the balancers 36.

In addition, the first extension 3711, the second extension 3713, and the third extension 3715 communicate with one end of the first balancer 361, one end of the second balancer 363, and one end of the third balancer (not illustrated) respectively.

To this end, each of the first extension 3711, the second extension 3713, and the third extension 3715 may include a first drain connector 3721, a second drain connector 3723, or a third drain connector (not illustrated) at the position at which the corresponding extension communicates with one end of the first balancer 361, the second balancer 363, or the third balancer (not illustrated).

The first drain connector 3721, the second drain connector 3723, and the third drain connector (not illustrated) are provided in the distal end of the first extension 3711, the distal end of the second extension 3713, and the distal end of the third extension 3715 respectively.

The balancer 36 includes a drain hole 3614 formed in the distal end thereof so as to provide the space for the drainage of water inside the balancer 36.

The drain hole 3614 communicates with the drain connector 3721 or 3723, such that the water inside the balancer 36 is drained through the corresponding extension and the drum 30 by passing through the drain hole 3614 and the drain connector 3721 or 3723.

Meanwhile, the balancer 36 may include a protrusion 3624 formed on the distal end thereof so as to protrude toward the drain connector 3721 or 3723.

In other words, the protrusion 3624 extends from the drain hole 3614 rearward of the drum 30.

The protrusion 3624 is provided at the position at which the balancer 36 communicates with the drain connector 3721 or 3723.

The protrusion 3624 is configured so as to be inserted into the drain connector 3721 or 3723. As such, the water inside the balancer 36 may completely move to the drain connector 3721 or 3723 without leakage between the balancer 36 and the extension.

The drain connector 3721 or 3723 includes a stepped surface 374, which is inwardly indented to allow the protrusion 3624 to be inserted thereinto. As such, once the protrusion 3624 has been inserted into the drain connector 3721 or 3723, the stepped surface 374 surrounds the outer circumferential surface of the drain connector 3721 or 3723, so as to prevent the leakage of water inside the balancer 36.

Each of the extensions includes a drain duct 381 or 383 provided therein.

The drain duct 381 or 383 communicates with the corresponding drain connector 3721 or 3723, and serves as a flow path, through which the water inside the balancer 36 is drained outward from the drum 30.

The drain duct 381 or 383 may be connected to the drain connector 3721 or 3723, or may be integrally provided inside in the extension. Alternatively, the drain duct 381 or 383 may be a separate member configured to be inserted into the extension.

The drain duct 381 or 383 communicates with the extension drain hole 373, such that the water temporarily stored in the drain duct 381 or 383 is drained outward from the drum 30 through the extension drain hole 373 and the drum drain hole (not illustrated).

Figure 3:
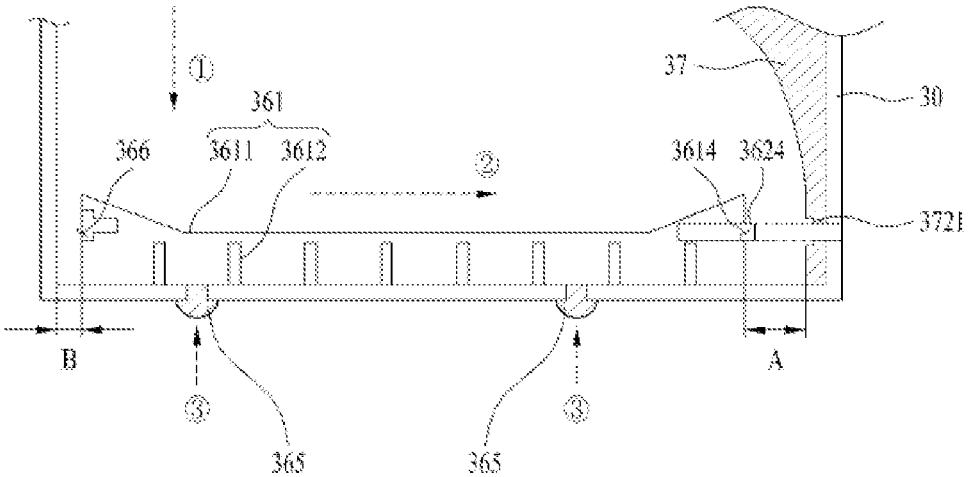
FIG. 3 is a view illustrating the sequence of assembling a drum, a balancer, and a power transmission unit of the laundry treatment apparatus in accordance with one embodiment of the present invention.
Figure 4:
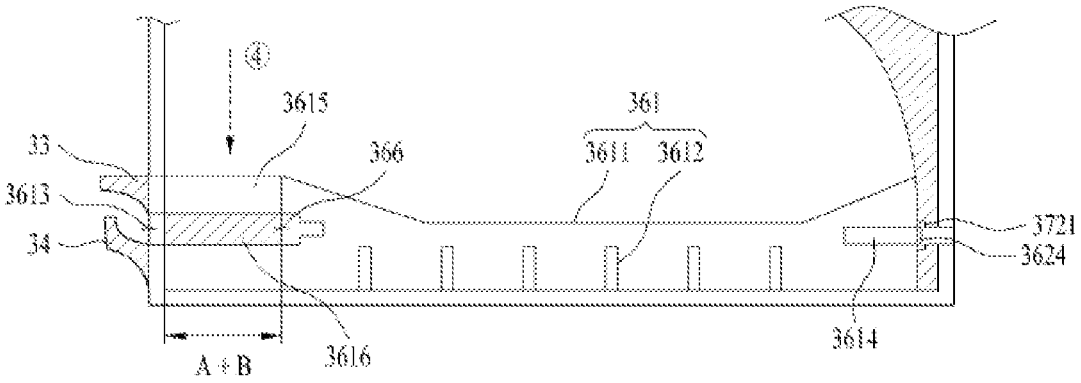
FIG. 4 is a view illustrating a balancer cover assembled between the drum and the balancer of the laundry treatment apparatus in accordance with one embodiment of the present invention.

FIG. 3 is a view illustrating the sequence of assembling the drum, the balancer, and the power transmission unit of the laundry treatment apparatus in accordance with one embodiment of the present invention, and FIG. 4 is a view illustrating a balancer cover assembled between the drum and the balancer of the laundry treatment apparatus in accordance with one embodiment of the present invention.

The balancer 36 may be assembled in the state in which the drum 30 is assembled inside the tub 20, or before the drum 30 is assembled inside the tub 20. Hereinafter, the assembly of the balancer 36 in the state in which the drum 30 is assembled inside the tub 20 will be described.

Referring to FIG. 3, the longitudinal length of the drum 30 may be greater than the longitudinal length of the balancer 36.

The longitudinal length of the drum 30 may be greater than the longitudinal length of the balancer 36 by A+B.

First, the balancer 36 is seated on the inner surface of the drum 30. Thereafter, the balancer 36 undergoes sliding in the longitudinal direction of the drum 30 until the protrusion 3624 of the balancer 36 communicates with the drain connector 3721 of the power transmission unit 37.

Subsequently, in order to couple the drum 30 and the balancer 36 to each other, the balancer 36 is fixed to the drum 30 using fastening members 365.

The fastening members 365 may be inserted from the outer surface to the inner surface of the drum 30 so as to fix the balancer 36 to the drum 30. On the other hand, the fastening members 365 may be inserted from the inner surface to the outer surface of the drum 30 so as to fix the balancer 36 to the drum 30. As illustrated in FIG. 4, once the balancer 36 has been fixed to the drum 30, the distance between the front surface of the drum 30 and one end of the balancer 36 may become A+B, which is the difference between the longitudinal distance of the drum 30 and the longitudinal distance of the balancer 36.

The laundry treatment apparatus in accordance with one embodiment of the present invention may include a balancer cover 3615, which is provided between the front surface of the drum 30 and one end of the balancer 36.

The balancer cover 3615 is configured such that the length thereof is A+B. The balancer cover 3615 is assembled between the front surface of the drum 30 and the balancer 36.

Accordingly, the balancer cover 3615 removes a gap between one end of the balancer 36 and the front surface of the drum 30, thereby allowing the water ejected from the balancer water supply unit 25 to easily move into the balancer 36.

The balancer cover 3615 may include a water supply channel 3616 therein.

The water supply channel 3616 may communicate, at one side thereof, with the balancer 36, and may communicate, at the other side thereof, with a gap between the first water supply guide 33 and the second water supply guide 34.

The water supply channel 3616 provides a flow path, through which the water supplied from the balancer water supply unit 25 may move into the balancer 36 through the gap between the first water supply guide 33 and the second water supply guide 34.

One end of the water supply channel 3616 communicates with the water supply hole 3613, and the other end of the water supply channel 3616 communicates with the inside of the balancer 36. As such, the water supplied from the balancer water supply unit 25 moves through the water supply hole 3613, the water supply channel 3616, and the balancer 36.

Figure 1B:
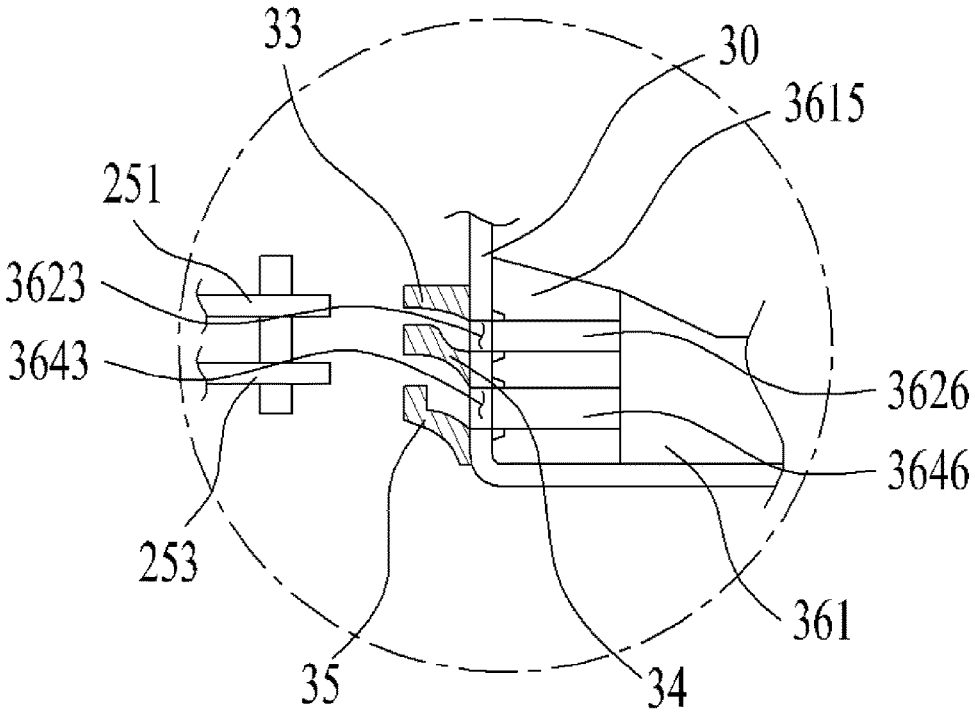
FIG. 1B is a view illustrating a laundry treatment apparatus in accordance with another embodiment of the present invention.

Referring to FIG. 1B, when a plurality of water supply holes 3613 is provided, the balancer cover 3615 may include a plurality of water supply channels 3626, 3646.

The water supply channels 3616 may be provided in the same number as the water supply holes 3613.

The water supply channel 3616 may be integrally formed with the balancer cover 3615. Alternatively, after the balancer cover 3615 is assembled between the front surface of the drum 30 and the balancer 36, the water supply channel 3616 may be inserted through the water supply hole 3613 from the front side to the rear side of the drum 30, and then may slide to the balancer 36 through the inside of the balancer cover 3615 so as to be inserted into and fixed to a fitting hole 366 formed in the balancer 36.

However, it is sufficient for the water supply channel 3616 to be provided inside the balancer cover 3615 and to provide a flow path, through which the water ejected from the balancer water supply unit 25 is capable of moving into the balancer 36.

As is apparent from the above description, the present invention has the effect of providing a laundry treatment apparatus, which may actively and efficiently remove the unbalance of a drum in the transient vibration state, which is an unbalanced state of the drum in which laundry is not uniformly distributed inside the drum.

In addition, the present invention has the effect of providing a laundry treatment apparatus, which is configured to efficiently drain water supplied into a balancer in order to actively eliminate the unbalance of the drum.

In addition, the present invention has the effect of providing a laundry treatment apparatus, which is configured to allow a balancer, which serves to actively eliminate the unbalance of the drum, to be more easily mounted to the drum, thereby accomplishing the efficient supply of water to the balancer.

The above detailed description is given to exemplify the present invention. In addition, the above description illustrates and describes the exemplary embodiment of the present invention, and the present invention may be used in various other combinations, changes, and environments. That is, the present invention may be changed or modified within the scope of the concept of the present invention disclosed in this specification, equivalents of the above disclosure, and/or the scope of technology or knowledge of the art. The above embodiment has been described with regard to the best mode to implement the technical idea of the present invention, and various modifications required in the concrete application fields and purposes of the present invention are possible. Accordingly, the above detailed description of the present invention is not intended to limit the present invention to the disclosed embodiment. In addition, the accompanying claims should be construed as including other embodiments.

[Mode For Invention]

As described above, a related description has sufficiently been discussed in the above "Best Mode" for implementation of the present invention.

INDUSTRIAL APPLICABILITY

As described above, the present invention may be wholly or partially applied to a laundry treatment apparatus.

The invention claimed is:

1. A laundry treatment apparatus comprising:

a cabinet defining an external appearance of the laundry treatment apparatus;

a tub installed inside the cabinet to accommodate wash water;

a drum rotatably provided inside the cabinet, the drum being configured to accommodate laundry therein;

a drive unit configured to generate torque required to rotate the drum;

a power transmission unit mounted on a rear wall of the drum, the power transmission unit being configured to transmit the torque generated by the drive unit to the drum so as to rotate along with the drum; and at least one balancer detachably assembled in an inner circumferential surface of the drum and including a cavity for receiving water selectively to eliminate unbalance occurring in the drum, the at least one balancer having a shorter length than a longitudinal length of the drum so as to be spaced apart from a front surface of the drum by a given distance; and a balancer cover assembled between the at least one balancer and the front surface of the drum, the balancer cover including a water supply hole configured to supply water to the cavity of the at least one balancer, wherein the at least one balancer includes a drain hole provided at a rear portion thereof and a protrusion extended rearward from the drain hole, wherein the power transmission unit includes a drain connector for coupling with the protrusion and a drain duct communicated with the drain hole through the protrusion for draining the water inside the at least one balancer to the tub, and wherein the at least one balancer and the balancer cover protrude to a predetermined height toward a center of rotation of the drum so as to lift the laundry inside the drum as the drum rotates.

2. The laundry treatment apparatus according to claim 1, further comprising a water supply channel provided inside the balancer cover for movement of the water to be supplied into the at least one balancer.

3. The laundry treatment apparatus according to claim 2, wherein the water supply channel is assembled by sliding from an outside of the front surface of the drum to an inside of the drum.

4. The laundry treatment apparatus according to claim 1, wherein the water supplied into the at least one balancer is supplied to a front of the at least one balancer and is drained to a rear of the at least one balancer.

5. The laundry treatment apparatus according to claim 1, wherein the at least one balancer is provided in a longitudinal direction on the inner circumferential surface of the drum.

6. The laundry treatment apparatus according to claim 2, further comprising:

a balancer water supply unit configured to penetrate the tub so as to be exposed between the tub and the drum, the balancer water supply unit serving to supply water to the at least one balancer.

7. The laundry treatment apparatus according to claim 6, wherein the water supply hole is provided in a front end of the balancer cover.

8. The laundry treatment apparatus according to claim 7, wherein the balancer water supply unit is located higher than the water supply hole.

9. The laundry treatment apparatus according to claim 7, further comprising a water supply guide configured to protrude from the water supply hole forward a front surface of the drum.

10. The laundry treatment apparatus according to claim 7, further comprising a water supply guide configured to be inclined from the water supply hole toward a center axis of the drum.

11. The laundry treatment apparatus according to claim 1, wherein the power transmission unit includes:

a center portion, to which a shaft is mounted; and a plurality of extensions configured to extend from the center portion in a radial direction of the drum, wherein the at least one balancer includes a plurality of balancers in communication with the plurality of extensions respectively.

12. The laundry treatment apparatus according to claim 11, wherein the extensions are provided in the same number as the at least one balancer.

* * * * *